United States Patent [19]

Seragnoli

[11] 4,209,955

[45] Jul. 1, 1980

[54] DEVICE FOR FEEDING AND CHECKING LAYERS OF CIGARETTES IN CIGARETTE PACKAGING MACHINES

[75] Inventor: Enzo Seragnoli, Bologna, Italy

[73] Assignee: G.D. Societa per Azioni, Bologna, Italy

[21] Appl. No.: 36,982

[22] Filed: May 8, 1979

[30] Foreign Application Priority Data

Jan. 6, 1978 [IT] Italy ..... 3459 A/78

[51] Int. Cl.[2] ..... B65B 57/14

[52] U.S. Cl. ..... 53/54; 53/150; 209/536; 209/577; 209/653

[58] Field of Search ..... 53/54, 150; 209/535, 209/536, 577, 653

[56] References Cited

U.S. PATENT DOCUMENTS

| | | | |
|---|---|---|---|
| 3,722,172 | 3/1973 | Seragnoli | 53/54 |
| 4,011,950 | 3/1977 | McLoughlin et al. | 209/536 |

*Primary Examiner*—Travis S. McGehee

*Attorney, Agent, or Firm*—Fitzpatrick, Cella, Harper & Scinto

[57] ABSTRACT

The device is conventionally associated to a cigarette packaging machine and comprises a hopper for successively distributing individual layers of adjacently disposed cigarettes into transferring means which successively transfer each layer into compartments intermittently moved in front of said transferring means. A plurality of layers are superimposed in each compartment to form a bundle to be fed to the wrapping means of the packaging machine. During the transferring, the layers are compelled to pass through a passage delimited by side guiding members and by an upper and a lower light-transparent guiding plate, said passage having a width substantially equal to the width of a layer and a height substantially equal to the diameter of a cigarette. The upper plate has a slot in the direction of the transverse dimension of the passage and this slot is subjected to the light rays generated by a light source transversely disposed relative to said passage and above said slot. The lower plate rests on a mounting having a number of built-in seats each aligned with a cigarette of a layer and each housing a photosensitive element. Should a defective layer be lacking of a cigarette a light ray energizes the photosensitive element provided in the position corresponding to said lacking cigarette so as to operate, through conventional cyclic and memory means, the ejection of that bundle containing said defective layer.

5 Claims, 4 Drawing Figures

DEVICE FOR FEEDING AND CHECKING LAYERS OF CIGARETTES IN CIGARETTE PACKAGING MACHINES

BACKGROUND OF THE INVENTION

The present invention relates to a device for feeding and checking layers of cigarettes in cigarette packaging machines. More precisely, the device comprises a combination of means which check the completeness and soundness of the layers of cigarettes which are superimposed to form the complete bundles subsequently fed to the wrapping means of the packaging machine. In particular, an apparatus in accordance with Italian Pat. No. 803,345 of the same applicant is known, comprising a feed hopper for the cigarettes.

Said hopper is devided at its bottom into a number of branches or elementary hoppers equal to the number of layers of cigarettes constituting a complete bundle to be packaged.

Each elementary hopper is provided internally with baffles forming channels of width slightly greater than the diameter of a cigarette, and of a number equal to the number of cigarettes which constitute the corresponding layer.

At the bottom or discharge mouth of each of said elementary hoppers there is provided a station for receiving said layers of adjacent cigarettes, which are then fed individually by a pusher device into compartments in an endless conveyor which is driven intermittently. Said bundles are gradually formed in said compartments by superimposing the layers one on the other.

At the end of this operation, it is not infrequent to find incomplete bundles inside the compartments in said endless conveyor.

According to the known art, in order to detect such defective bundles, which are then ejected, electromechanical devices are used comprising sensing members consisting of feeler pins opposed by resilient means.

These pins press axially against the ends of the cigarettes, to check not only their presence but also their correct degree of end filling, and the correctness of their longitudinal dimensions. These devices can carry out their checking action, as described in Italian Pat. No. 921,005 of the same applicant, either in said channels or alternatively in the path of the said endless conveyor.

The result of this checking operation is then transmitted via a memory device both to a device for ejecting the defective groups disposed in the path of said endless conveyor, and to the feed means for the various wrapping materials and sealing labels, so that they suspend delivery relative to the ejected bundles. However, it frequently happens that incomplete bundles are not detected by said electromechanical devices.

This is due to the fact that in the case, for example, of the absence of a cigarette, two adjacent feeler pins can become pressed simultaneously by one and the same cigarette which has become disposed in an irregular position because of the absence of an adjacent cigarette.

Optical devices are also known for checking the completeness of the bundles.

In these latter devices, which are normally located in the path of said endless conveyor, one end of each cigarette making up the bundle is illuminated by a light beam directed along its axis. Photosensitive elements are provided facing the other ends of the cigarettes, and if one or more cigarettes are absent, these become illuminated and activate a device for ejecting the defective group.

A considerable disadvantage of these latter devices derives however from the fact that during the described operations, a certain quantity of tobacco dust is released from the cigarettes. This dust inevitably deposite on said photosensitive elements or on any transparent protection elements, making them insensitive to light and reducing the effectiveness of the entire checking device.

In addition, these optical checking devices are not able to check the exactness of the longitudinal dimensions of the individual cigarettes, in that even shorter cigarettes (for example lacking the filter) intercept the light beams directed towards the photosensitive elements to the same extent as the other cigarettes of the bundle.

SUMMARY OF THE INVENTION

The object of the present invention is to provide a device for checking the completeness of the layers of cigarettes which are superimposed to form the bundles destined for the wrapping means of the packaging machine, which is able to overcome all the drawbacks of known devices both of electromechanical and optical type.

A further object of the present invention, in conformity with the preceding object, is to provide a device of the aforesaid type able to check the correctness of the longitudinal dimensions of the cigarettes making up said layers.

These and further objects are attained by the device for feeding and checking layers of cigarettes in cigarette packaging machines, comprising stations for receiving layers of adjacent cigarettes at the discharge ports of a hopper for forming and dispensing said layers, compartments for containing bundles constituted by superimposed layers of cigarettes mounted on means which advance with intermitten motion in proximity to said stations, means for supporting and guiding said layers being disposed between each of said stations and said compartments, pusher means provided with outward and return motion parallel to the cigarette axes for transferring said layers from said stations, through said support and guide means and into said compartments, photoelectric checking means for said layers and cyclic actuation means which, in combination with each other, control ejection means for the bundles containing defective layers, characterized in that each of said support and guide means comprises a pair of horizontal sheets of light-transparent material which between them define a passage having a width which is slightly greater than the diameter of a cigarette, said photoelectric means comprising illumination means external to said passage and disposed transversely to the cigarette axes to deliver light beams substantially of the same intensity and of a substantially vertical path over a portion of the zone through which each cigarette travels through said passage, photosensitive elements, one for each cigarette, external to said passage on the side opposite said illumination means and facing the zones through which each cigarette travels, and aligned with the corresponding light beam, and fixed screening means associated with each photosensitive element for intercepting and absorbing light rays external to said corresponding light beam.

DESCRIPTION OF THE PREFERRED EMBODIMENT

Figure 1:
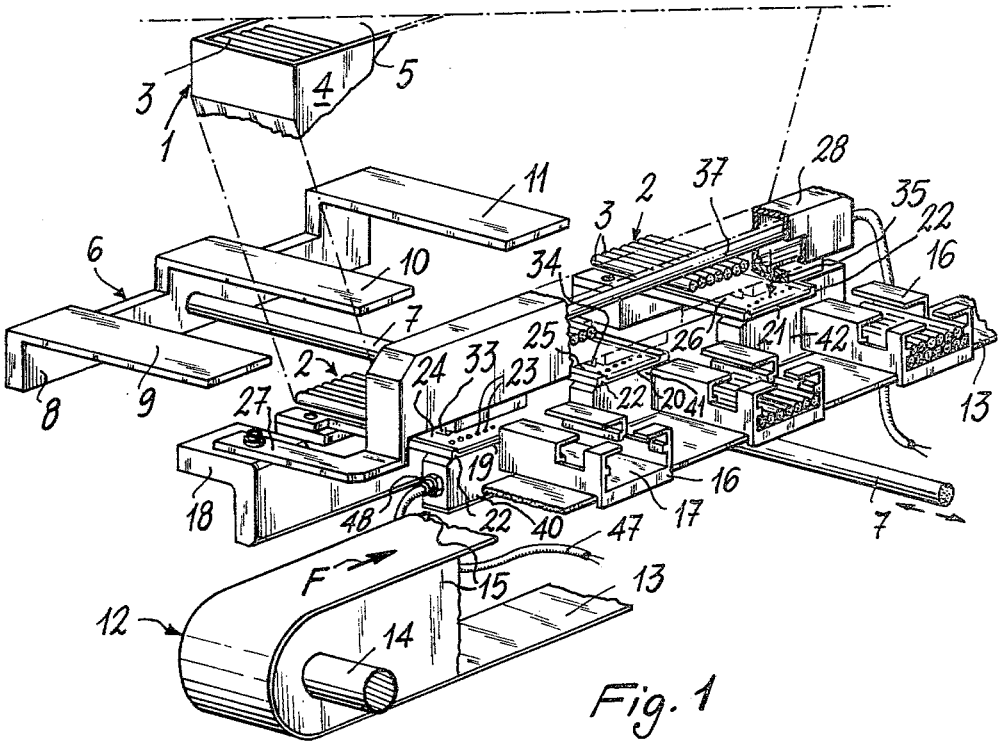
FIG. 1 is a diagrammatic perspective view, with certain parts shown sectioned or removed in order to give an improved view of other parts, of the checking device according to the invention fitted to a machine for forming and wrapping bundles of cigarettes.

With reference to FIG. 1, the reference numeral 1 indicates a hopper for feeding layers 2 of cigarettes 3 forming part of a cigarette packaging machine of the type described for example in Italian Pat. No. 803,352 of the same applicant.

Said hopper 1 is bounded at its front and rear by vertical parallel walls 4 and 5 spaced apart by a distance which is slightly greater than the length of a cigarette.

The lower part of the hopper 1 is divided into three branches or elementary hoppers, not shown.

At the bottom ends or discharge ports of these elementary hoppers, fixed stations, in the form of means described hereinafter, are provided for receiving said layers.

Said stations lie in horizontal planes at levels which increase from left to right and are offset from each other by distances substantially equal to the diameter of a cigarette.

The reference numeral 6 indicates overall a pusher disposed to the rear of the hopper 1, with reference to FIG. 1, and mounted on a shaft 7 normal to the walls 4 and 5 and driven with reciprocating axial movement.

The pusher 6 comprises a bar 8 transverse to the shaft 7, and three headpieces 9, 10, 11 constituted by substantially rectangular horizontal plates rigidly connected at their rear ends to the bar 8, with reference to FIG. 1.

The headpieces 9, 10, 11 are disposed respectively at a level lying between each of said discharge ports and the corresponding receiving station, towards which their front edge points, to constitute the actual thrust surface.

The reference numeral 12 indicates overall a conveyor for conveying complete bundles of cigarettes to the wrapping line of the packaging machine, this conveyor being disposed on the other side of the hopper to the pusher 6.

The said conveyor 12 is constituted essentially of a horizontally extending belt 13 passing endlessly around rollers or toothed wheels, not shown, which have their axes normal to the walls 4 and 5 of the hopper 1.

The reference numeral 14 indicates a shaft which rotatably supports one of said rollers, and 15 indicates two supports and guide plates for the belt 13 normal to the shaft 14.

On said belt 13, which is driven, in a manner not shown, with intermittent motion in the direction indicated by the arrow F, there are fixed substantially parallelepiped compartments or containers 16 at equal distances apart, their interiors having a height substantially equal to the thickness of a bundle formed from three overlying layers 2, and open at the two opposite faces parallel to the walls 4 and 5 of the hopper 1.

On the upper branch of the belt 13, the horizontal walls 17 which lowerly bound the compartments 16 are coplanar with that receiving station disposed at the lowest level (the left band one with reference to FIG. 1).

The compartments 16 are disposed on the belt 13 such that each time the belt halts, three compartments lie on the trajectory of the headpieces 9, 10 and 11, and are aligned with said fixed receiving stations.

A horizontal support bar 18 is disposed below the hopper 1, parallel to the conveyor 12.

At the three outlet ports, the bar 18 supports three substantially rectangular plates 19, 20 and 21 laying in horizontal planes at an increasing level from left to right, so that they are equidistant from their respective discharge ports.

Figure 2:
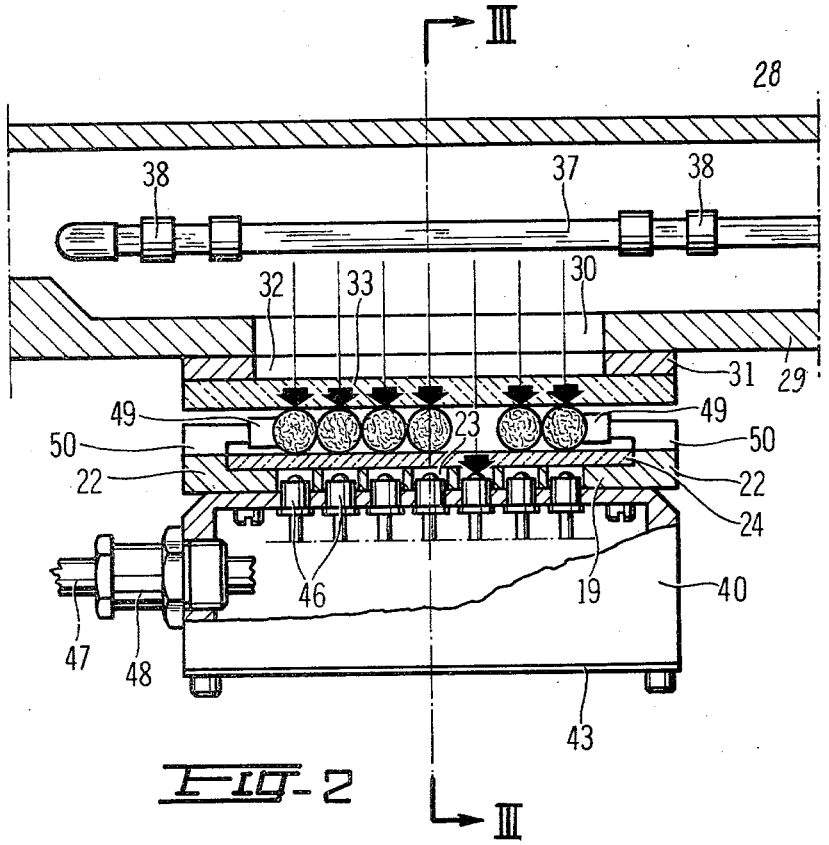
FIG. 2 is a frontal view of part of the device according to the present invention, shown partly in section and with parts removed for clarity.

The plates 19, 20 and 21 which are longitudinally normal to the walls 4 and 5 of the hopper 1, have one end which extends to a position close to the belt 13, and are bounded on their longitudinal sides by raised edges 22 (see also FIG. 2).

In proximity to said end, the three plates 19, 20 and 21 are traversed by a series of equidistant bores 23 of vertical axis, lying in a straight line parallel to the conveyor 12.

The number of bores 23 in each of said plates is equal to the number of cigarettes which make up the respective layer. Three plates of light-transparent material 24, 25 and 26, are fitted between said raised edges 22, and cover the entire surface of the three plates 19, 20 and 21 respectively.

The upper faces of the plates 24, 25 and 26 are substantially coplanar with the lower faces of the headpieces 9, 10 and 11 respectively of the pusher 6, and constitute at the discharge ports of the hopper 1 the said fixed stations for receiving the layers 2 of cigarettes.

Figure 3:
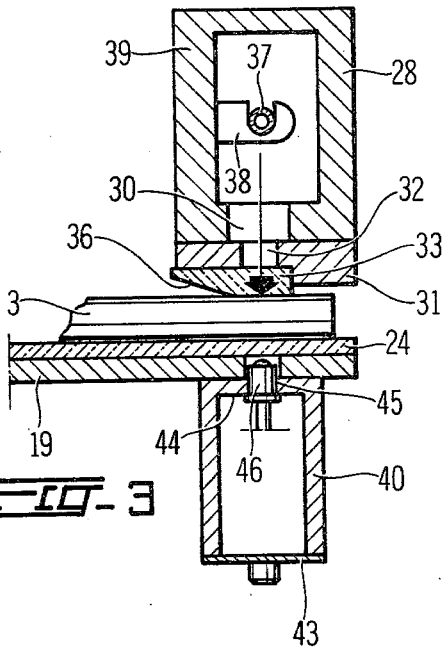
FIG. 3 is a sectional side view of that part of the device according to the present invention shown in FIG. 2.

A substantially parallelepiped box member 28 extending between the hopper 1 and conveyor 12 (see also FIGS. 2 and 3, which relate to one of said layers) is supported by the two ends of the support bar 18 by way of brackets 27 (only one of which is visible in FIG. 1).

The box member 28 is bounded lowerly by a horizontal wall 29 provided with three apertures or slots 30 facing the three plates 24, 25 and 26, and extending transversely to these latter at the bores 23 in the plates 19, 20 and 21.

Three plates 33, 34 and 35 of light-transparent material are fixed, in the form of covers, below said wall 29, by way of plates or spacers 31 provided with slots 32 corresponding to the slots 30. The three plates 33, 34 and 35 overlap the plates 24, 25 and 26 respectively by a distance slightly greater than the diameter of a cigarette, and comprise a lower bevel 36 on the side facing the hopper 1.

The box member 28 is traversed internally, in the direction of its major dimension, by illumination means consisting of a tubular lamp 37 supported by brackets 38 from the rear wall 39 (with reference to FIG. 1).

Three substantially parallelepiped containers 40, 41 and 42, closed lowerly by covers 43, are fixed to the lower faces of the plates 19, 20 and 21 at the ends close to the conveyor 12. The upper walls 44 of said containers 40, 41 and 42 adhering to the plates 19, 20 and 21 are provided with through bores 45 of vertical axis, of equal number to the number of bores 23 and alighed therewith.

The bores 45 constitute the seats for photosensitive elements 46, for example of semiconductor type, facing the sheets 24, 25, 26.

The photosensitive elements 46 relative to each of said walls 44 are connected together in a manner not shown, and are also connected to an electric cable 47 leaving the respective container 40, 41, and 42 through a cable gland 48.

The passages defined by the three pairs of sheets 24 and 33, 25 and 34, 26 and 35 are bounded laterally by the concave surfaces of bars 49 which extend normal to the wall 4 and are supported from the raised edges 22 by angle pieces 50 (see FIG. 2).

As will be apparent hereinafter, the upper and lower sheets of transparent material together with the bars 49 form support and guide means for the layers 2 of cigarettes originating from said fixed receiving stations.

The operation of the device according to the present invention will now be described.

Figure 4:
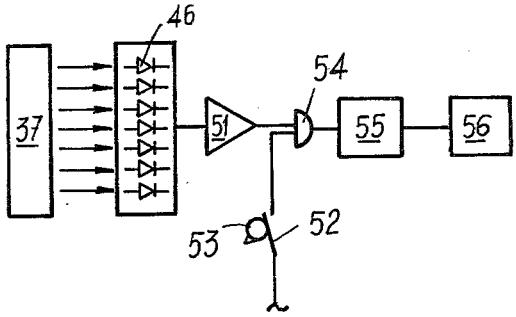
FIG. 4 is a diagrammatic illustration, in the form of a block diagram, of the electrical circuit of the device according to the invention.

In this description, reference will also be made to the block diagram of FIG. 4, which shows an amplifier 51 for the signals emitted by the light sensitive elements 46, and an actuation contact 52 which is closed during each operating cycle of the packaging machine by a cam 53 connected to the drive means for the pusher 6.

The reference numerals 54 indicates a logic AND element with two inputs connected respectively to the output of the amplifier 51 and to the circuit branch comprising the contact 52. A memory element 55 and an expulsion device 56 are connected in cascade to the output of the AND element 54.

Under normal operating conditions in the known manner, when the pusher 6 withdraws towards its left hand limiting position (see FIG. 1), a layer 2 of adjacent cigarettes is deposited by falling from the corresponding discharge port, on to each of the three receiving stations, i.e. on to the three sheets 24, 25 and 26.

In the case shown in FIG. 1, these layers are formed from seven cigarettes 3 on the two outer sheets 24 and 26, and six cigarettes 3 on the intermediate sheet 25.

The pusher then begins its outward stroke to bring the ends of the three headpieces 9, 10 and 11 into contact with the rear ends of the cigarettes making up the three layers.

The three headpieces 9, 10 and 11 then become inserted between said discharge ports and the sheets 24, 25 and 26, to thrust the three layers axially over the support and guide means consisting of the upper and lower sheets of transparent material and the lateral bars 49, until they become inserted at three different levels into the three compartments 16 which are at rest.

More precisely, proceeding in the direction of movement of the belt 13 (see FIG. 1) a first layer of seven cigarettes is inserted, in contact with the base wall 17, into the first compartment 16, which is empty, a second layer of six cigarettes is inserted into the second compartment 16 on top of a layer of seven cigarettes already inserted during the previous cycle, and finally a group of twenty cigarettes is completed in the third compartment by inserting a layer of seven cigarettes on top of two layers of seven and six cigarettes inserted during the two previous cycles.

At this point, while the belt 13 makes a further movement or step to return to the situation shown in FIG. 1, the pusher 6 withdraws toward its left hand limiting position.

As the headpieces 9, 10 and 11 become removed from the respective discharge ports of the hopper 1, a further three layers of cigarettes fall by gravity on to the sheets 24, 25 and 26 you await the next outward stroke of the pusher 6.

Referring now for example to a single layer, and in particular to that engaged by the headpiece 9 (see FIG. 2 and 3), as the cigarettes 3 slide axially through the passage defined by the two sheets 24 and 33, and in particular between the bores 23 and slot 32 in synchronism with the closure of directed towards the photosensitive elements 46.

If the layer is complete, then there is no signal at the output of the amplifier 51 or consequently at the output of the logic AND element 54.

If one or more cigarettes are absent from this layer, the photosensitive elements 46 corresponding to the missing cigarettes are struck by light beams normal to the sheets 24 and 33.

Consequently, under these conditions, the input of the logic AND element 54 receives both the signal originating from the circuit branch comprising the contact 52, and a signal originating from the photosensitive elements 46 corresponding to the missing cigarettes, by way of the amplifier 51. Under such conditions, the AND element 54 feeds a signal to the memory element 55, which is then transmitted by this latter to the expulsion device 56 disposed in the path of the conveyor 12.

The action of the expulsion device 56 on the bundle containing the defective layer or layers is obviously delayed by the memory element 55, beyond the described checking operation, by the number of machine cycles necessary for the compartment containing the incomplete layer or layers to reach the ejection zone.

Reference has been made heretofore only to simply checking the completeness of the layers of cigarettes. Under such conditions, it is sufficient for the cam 53, during the passage of the layers 2 across the bores 23, to close the actuation contact 52 and then reopen it immediately.

If it is required to check both the completeness of the layers and the longitudinal dimensions of the cigarettes, the actuation action of the cam 53 must be extended over the entire period of time necessary for passage of the layers across the bores 23. This can be attained simply by suitably sizing the contour of the cam 53.

The very high reliability of the device according to the present invention can be attributed to various reasons.

The photoelectric elements are protected by sheets of light transparent material which are kept perfectly free from tobacco dust by the continuous sliding action of the layers of cigarettes. In addition, the light source, constituted by a single tubular lamp or by one tubular lamp for each layer, delivers light beams through said slots which are substantially of the same intensity at the line through which each cigarette passes, and are directed towards the photosensitive elements associated with each cigarette.

For this reason and as a consequence of the screening action against external light sources, which is provided both by the bars 49 and by the internal surfaces of the bores 23, the photosensitive elements, which are preferably of semiconductor type, operate under ideal conditions.

In this respect, during the checking operations, i.e. on passage of the cigarette layers, said photosensitive elements are in semi-darkness if a corresponding cigarette is present, or are perfectly illuminated if the cigarette is absent.

The screening action of said means can be accentuated by covering the internal surfaces of the bores 23 with black opaque paint, and by inserting the photosensitive elements 46 more deeply into their seats.

For this purpose, these photosensitive elements can be mounted adjustably on the support walls 44.

Finally, it should be noted that any irregular arrangement of the cigarettes, due to the incompleteness of the layer which they comprise, in no way influence the checking operation of the device according to the present invention, in contrast to that which happens with electromechanical devices of known type.

For example with reference to FIG. 2, any movement of the cigarettes (and in particular those close to the missing cigarette) from their regular sliding positions results in the creation of further interruption zones in the screen constituted by the layer, consequently illuminating and energising the corresponding photosensitive element 46.

What I claim is:

1. A device to be associated to a cigarette packaging machine for forming bundles constituted by a plurality of superimposed individual layers of adjacent cigarettes and for checking the faultless conditions of said individual layers during the formation of said bundles comprising:

a hopper having discharging ports for forming and dispensing said individual layers;

side-by-side disposed stations each for successively receiving a layer from the respective discharging port;

compartments for containing said bundles mounted on means intermittently moving traversely to and in front of said stations;

means disposed between each of said stations and said compartments for supporting and guiding said individual layers, said means delimiting a passage formed by side guiding members and by an upper and a lower light-transparent guiding plate and having a width substantially equal to the width of a layer and a height substantially equal to the diameter of a cigarette;

a first fixed screen means external to said passage associated to and disposed above said upper light-transparent guiding plate, said first screen means being in the form of a slot developing in the direction of the transverse dimension of said passage;

a pusher means reciprocatingly moving in line with the cigarette axes for transferring said individual layers from said stations, through said passages into said compartments;

a light source disposed above said slot;

a mounting external to said passage on the side thereof opposite said light source associated to and disposed below said lower light transparent guiding plate and having a number of built-in seats each housing a photosensitive element, each aligned with a cigarette of a layer and all facing said slot;

a second fixed screen means each associated to each of said seats, said second screen means being in a tubular form with axis directed perpendicularly towards said slot;

ejection means for ejecting bundles containing defective layers; and cyclic means associated with said photosensitive elements for controlling said ejection means.

2. A device according to claim 1, wherein said light source comprises for each of said passage a horizontal tubular lamp normal to the direction of travel of the cigarette layers and of a length at least equal to the transverse dimension of the relative passage, and a box member for containing and supporting said lamp provided in a wall facing said passage with an aperture extending parallel to said lamp over a distance substantially equal to the transverse dimension of said passage.

3. A device according to claim 1, wherein said photosensitive elements are of the semiconductor type and said seats for said photosensitive elements are provided with adjusting means for their adjustment along the axis of said second screen means.

4. A device according to claim 1, wherein the internal surfaces of said second fixed screen means are coated with a black opaque material.

5. A device as claimed in claim 1, wherein said cyclic actuation means are mechanically linked to said pusher means and are provided and regulated to supply their actuation signal at each cycle to said ejection means over the entire period of time necessary for the passage of said layers across said photosensitive elements.

* * * * *

UNITED STATES PATENT AND TRADEMARK OFFICE

CERTIFICATE OF CORRECTION

PATENT NO. : 4,209,955

DATED : July 1, 1980

INVENTOR(S) : Enzo Sergnoli

It is certified that error appears in the above-identified patent and that said Letters Patent are hereby corrected as shown below:

Assignee: "G.D. Societa per Azioni" should be --G.D Societa per Azioni--;

Foreign Application Priority Data, "Jan. 6, 1978" should be --June 1, 1978--;

Col. 6, line 4, "you" should be --to--;

line 11, after "of" add --the contact 52 by the cam 53, they intercept the light beams--.

Signed and Sealed this

*Twenty-third* Day of *September 1980*

[SEAL]

*Attest:*

SIDNEY A. DIAMOND

*Attesting Officer*

*Commissioner of Patents and Trademarks*